US006544588B2

(12) United States Patent
Yamamori et al.

(10) Patent No.: US 6,544,588 B2
(45) Date of Patent: Apr. 8, 2003

(54) SURFACE DECORATED ARTICLE AND DECORATION METHOD THEREOF

(75) Inventors: Masato Yamamori, Nagoya (JP); Masataka Muramatsu, Okazaki (JP); Katsuhiro Ishikawa, Toyota (JP); Hirotsugu Isobe, Nagoya (JP); Haruhiko Mochizuki, Hannou (JP)

(73) Assignee: Trinity Industrial Corporation, Toyota (JP)

( * ) Notice: Subject to any disclaimer, the term of this patent is extended or adjusted under 35 U.S.C. 154(b) by 0 days.

(21) Appl. No.: 09/854,547

(22) Filed: May 15, 2001

(65) Prior Publication Data

US 2001/0031352 A1 Oct. 18, 2001

Related U.S. Application Data

(62) Division of application No. 09/287,355, filed on Apr. 7, 1999, now abandoned.

(30) Foreign Application Priority Data

Jul. 8, 1998 (JP) ..... 10/224399
Jul. 8, 1998 (JP) ..... 10/224400

(51) Int. Cl.[7] ..... B05D 1/02; B05D 1/34

(52) U.S. Cl. ..... 427/261; 427/262; 427/267; 427/426

(58) Field of Search ..... 427/197, 199, 427/201, 256, 280, 426, 427, 202–205, 261–262, 267; 428/206–208

(56) References Cited

U.S. PATENT DOCUMENTS

| | | | | |
|---|---|---|---|---|
| 5,202,180 A | | 4/1993 | Watts | 428/324 |
| 5,667,891 A | * | 9/1997 | Batzar et al. | |
| 5,899,144 A | | 5/1999 | Parks | 101/129 |
| 5,948,488 A | | 9/1999 | Marecki et al. | 428/30 |

* cited by examiner

*Primary Examiner*—Fred J. Parker
(74) *Attorney, Agent, or Firm*—Pillsbury Winthrop LLP

(57) ABSTRACT

A surface decorated article in which a surface is entirely or partially decorated with a coating of a first and second glitter paints each using a flaky glitter material as a pigment, wherein first paint particles at a low viscosity with a relatively high solvent dilution ratio formed by coarsely particulating a glitter paint and second paint particles at a high viscosity with a relatively low solvent dilution ratio formed by coarsely particulating a glitter paint are coated in a state mixed with each other, to form the coating comprising areas in which the first paint particles are dried to solidify and areas in which the second paint particles are dried to solidify are mixed together in a spotwise pattern. The surface of articles can be provided with colors or textures exhibiting unique and high quality feelings.

11 Claims, 6 Drawing Sheets

SURFACE DECORATED ARTICLE AND DECORATION METHOD THEREOF

This application is a divisional of U.S. application Ser. No. 09/287,355 filed on Apr. 7, 1999 abandoned.

BACKGROUND OF THE INVENTION

1. Field of the Invention

The present invention concerns a surface decorated article and a decoration method thereof by applying coating for decoration to the surface of a substrate comprising, for example, plastic, metal, wood, glass and ceramics, thereby giving aesthetic appearance.

2. Statement of the Prior Art

Paint is generally applied mainly with an aim of obtaining protection effects such as improvements of rust prevention, corrosion inhibition and weather proofness, effects of enhancing the physical property and functionality such as improvement of the surface hardness and the heat resistance or provision of electric insulation or electroconductivity, and a decorative effect for giving an aesthetic appearance by the color or texture of a coating membrane of a paint. In particular, it is one of most important decorative methods for metal or wooden articles to provide a desired color or texture on the surface.

On the other hand, in plastic articles capable of pigmenting molding materials per se to a desired color or providing a texture such as unevennesses by a molding die, coating is not always indispensable and decorative coating is not applied as a surface finishing required in metal or wooden articles (provision of aesthetic appearance) but applied mainly as a substitute for printing of patterns or marks.

However, application use of plastic articles has been extended remarkably in recent years and plastic molding products capable of decreasing weight and cost due to their good moldability have been used generally for interior and exterior parts of automobiles as well as for domestic electric articles or electronic equipment such as office automation equipment and, accompanying therewith, demand for coating plastic articles with an aim of obtaining the decorative effect of providing aesthetic appearance has been increased remarkably.

Particularly, for automobile interior parts, it has been demanded for decorative coating with high quality feeling and having both good quality of appearance that creates comfortable residential space in a car interior and giving a unique feature that can satisfy users' individual tastes.

However, it is not easy by the coating to apply unique decoration having high quality feeling, since the type and the number of colors of paints available are limited and the coating method is also restricted, so that a complicated design by combination of a multiplicity of colors or motifs can not be constituted as in the case of printing.

Particularly, in a spray coating of a paint by a coating machine such as a spray gun, it is impossible to provide a spatial feeling by weaving a coating using a brush or a roll as in stipple coating and variation of textures in the coating is limited.

Further, it is possible for ceilings and walls of buildings to apply stipple coating or sand blast coating of blowing a cement resin paint incorporated with coarse powdery limestone or silicic stone by a mortar gun of 3 to 5 mm bore diameter thereby providing an uneven pattern. However, such coating is not applicable to the surface finishing of industrial articles such as automobiles, domestic electronics articles or electronic equipment, since the texture of the coating is coarse.

In the coating used for surface finishing of industrial articles, there have been known a hammer tone coating of blowing a paint blended with a silicone resin by a spray gun to develop a hammer-struck spatial pattern in a planar state, cracking coating of blowing cracking enamel to an intercoat layer to cause cracks in the coating, or reticulation coating causing fine wrinkles on the surface of a coating. However, reticulation coating has been used long since for the surface finishing of optical instruments such as microscopes and cameras or metal lockers, and the hammer tone coating is common as the surface finishing of machine tools, so that they lack in uniqueness and also in high quality feeling.

In addition, there have been also known metallic coating of providing metallic gloss with the coating of a metallic paint using flaky glitter material such as an aluminum powder or aluminum flake as a pigment, and pearlescent coating of providing pearlescent or iridescent gloss by a coating of a pearlescent pigment using flaky glitter material as a pigment. However, a monotonous texture of merely giving metallic gloss or pearlescent gloss uniformly on the entire coating is common and lacks in uniqueness, so that they can not always be said to provide a high quality feeling but rather deteriorate the high quality feeling depending on the industrial articles.

SUMMARY OF THE INVENTION

It is, accordingly, an object of the present invention to provide a color or texture which is unique and of high quality feeling and optimal also to the surface finishing of industrial articles by using a metallic paint using flaky glitter material as a pigment or a glitter paint such as a pearlescent pigment, by a method different from the conventional coating.

SUMMARY OF THE INVENTION

The foregoing object of the present invention is attained by a surface decorated article in which a surface is entirely or partially decorated with a coating of a glitter paint using a flaky glitter material as a pigment, wherein paint particles at a low viscosity with a relatively high solvent dilution ratio formed by coarsely particulating a glitter paint and paint particles at a high viscosity with a relatively low solvent dilution ratio formed by coarsely particulating a glitter paint are coated in a state mixed with each other, to form a coating of a glitter paint comprising areas in which the paint particles at a low viscosity are dried to solidify and areas in which the paint particles at a high viscosity are dried to solidify are mixed together in a spotwise pattern.

According to the present invention, in the process that the paint particles at a low viscosity and the paint particles at a high viscosity coated on the surface of a surface decorated article are dried to solidify by evaporation of the solvent, paint particles at a low viscosity with the high solvent dilution ratio show large volume shrinkage upon evaporation of the solvent and, therefore, flaky glitter material contained in the paint particles flow so as to be in parallel with the coated surface and aligned in this direction, so that the areas in which the paint particles at the low viscosity are dried to solidify show large hiding power and high light reflectance on the coating surface by the flaky glitter material.

On the other hand, since the paint particles at the high viscosity with the low solvent dilution ratio show small volume shrinkage upon evaporation of the solvent and, therefore, the flaky glitter material flows less by the effect of the volume shrinkage and not much flaky glitter material is aligned in parallel with the coating surface, so that the areas in which the coated particles at the high viscosity are died to solidify show small hiding power and low light reflectance on the coating surface compared with the areas in which the paint particles at the low viscosity are dried to solidify.

Accordingly, the coating of the glitter paint, having areas in which the paint particles at the low viscosity are dried to solidify and areas in which the paint particles at the high viscosity are dried to solidify are mixed together in a spotwise pattern, develops a unique spotwise pattern having spot areas emitting brilliant gloss by the reflection of light and spot areas emitting dark gloss mixed with each other. The degree of gloss in the spot areas change subtly depending on the view angle, and an uneven feeling in appearance is given in a planar state being coupled with the change and the bright/dark contrast, to provide the surface decorated article with appearance of deep and high quality feeling.

DETAILED DESCRIPTION

The present invention will be explained specifically by way of preferred embodiments with reference to the accompanying drawings.

Figure 1:
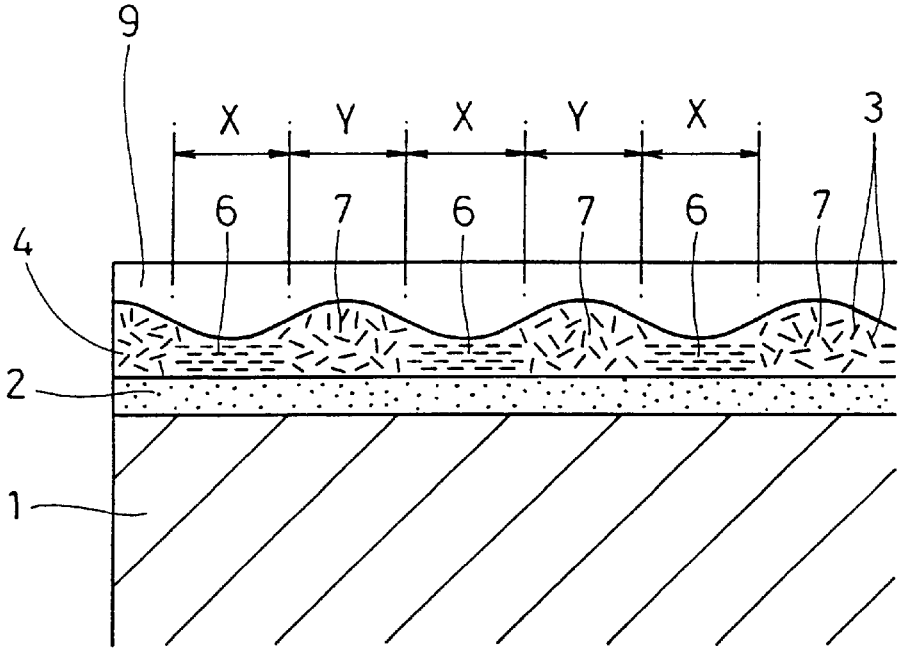
FIG. 1 is a cross sectional view of a surface decorated article illustrating a first embodiment according to the present invention.
Figure 4:
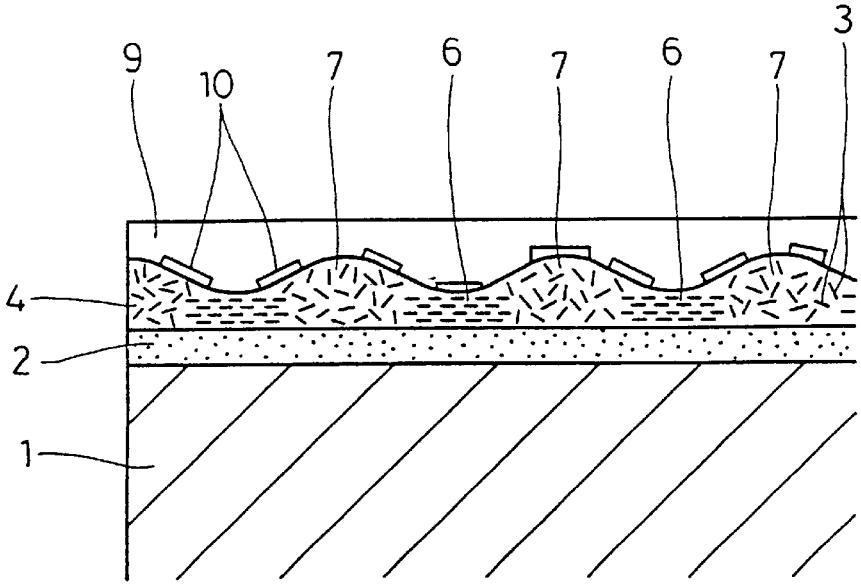
FIG. 4 is a cross sectional view of a surface decorated article illustrating a second embodiment according to the present invention.
Figure 7:
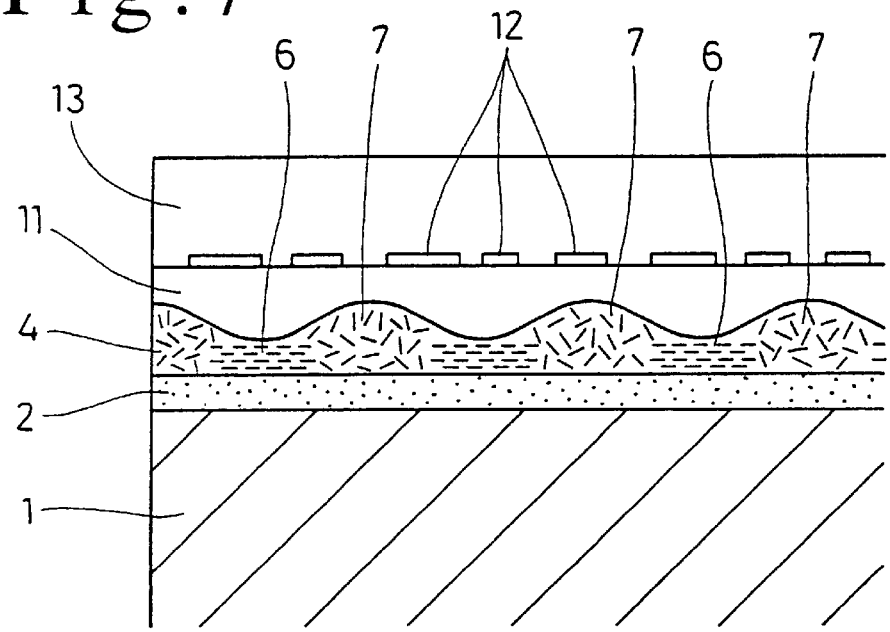
FIG. 7 is a cross sectional view of a surface decorated article illustrating a third embodiment according to the present invention.
Figure 8:
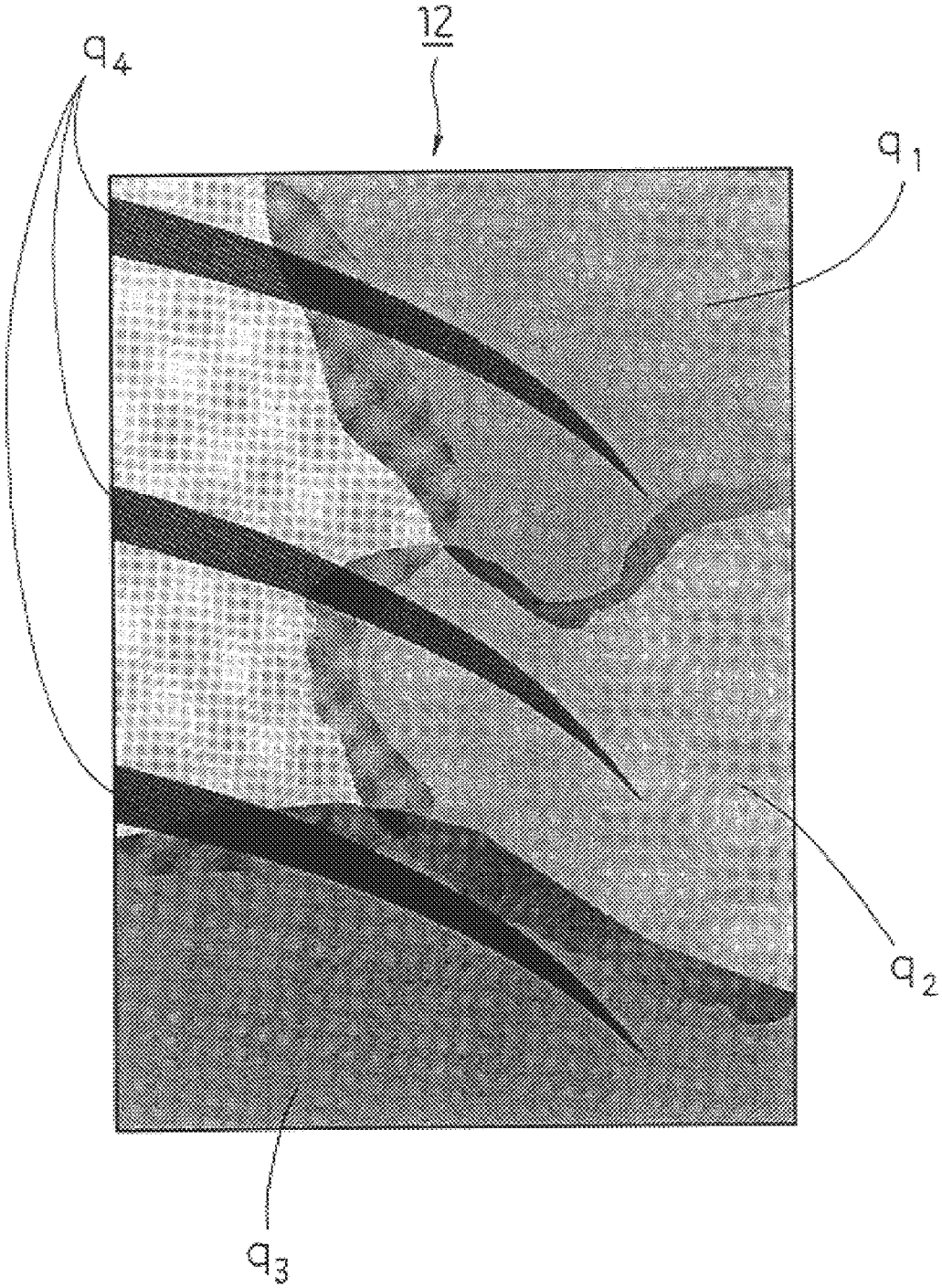
FIG. 8 is a plan view illustrating an example of an ink pattern printed on the coating of a glitter paint and formed on the surface of the surface decorated article.

For each surface decorated article shown in FIG. 1, FIG. 4 and FIG. 7, a basecoat 2 comprising a coating of a primer paint or a base coloring paint for improving the depositability of a paint is applied to the surface of a substrate 1 molded into the shape of various kind of articles from a coatable material such as plastics or metals, and a coating 4 of a glitter paint using flaky glitter material 3 as a pigment is formed on the basecoat 2.

Figure 2:
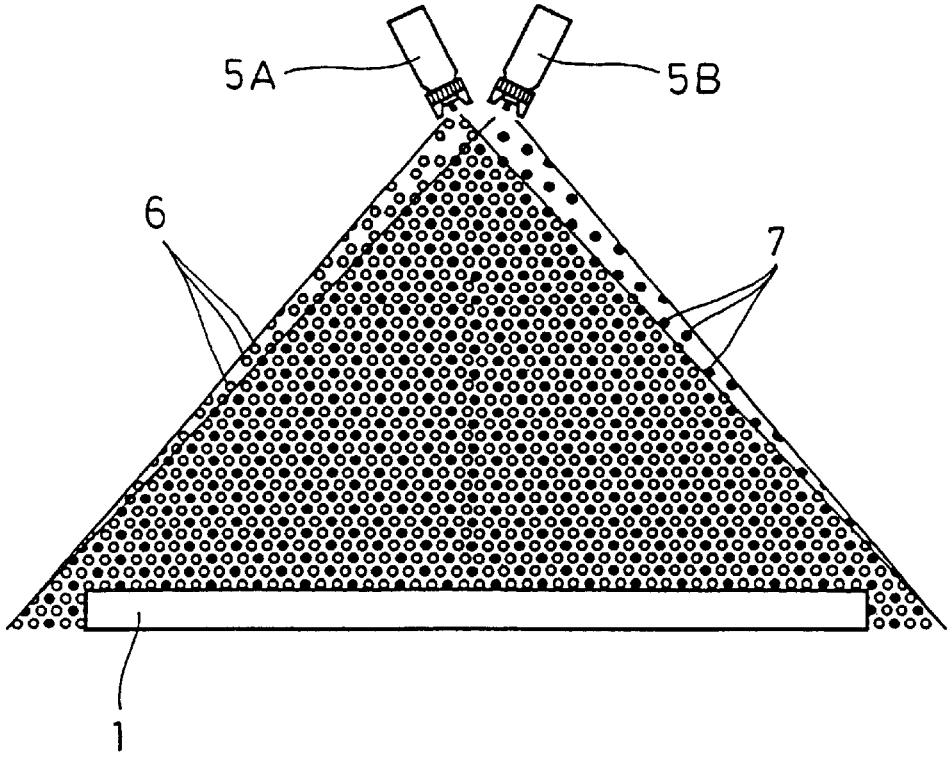
FIG. 2 is a view illustrating an example of a coating method for forming a coating of a glitter paint on the surface of a surface decorated article.

At least two kinds of glitter paints with different solvent dilution ratios are prepared, paint particles of a glitter paint at a low viscosity with a relatively high solvent dilution ratio are coarsely particulated by a coating machine 5A and, at the same time, paint particles of a glitter paint at a high viscosity with a relatively low solvent dilution ratio are coarsely particulated by a coating machine 5B, for example, as shown in FIG. 2. The paint particles 6 at a low viscosity in the coating machine 5A and the paint particles 7 at a high viscosity in the coating machine 5B are coated to the surface of the substrate 1 already applied with the basecoat 2 in a state where they are mixed with each other, to thereby form a coating having areas in which the paint particles 6 at a low viscosity are dried to solidify and areas in which the paint particles 7 at a high viscosity are dried to solidify, being present in admixture at a spotwise pattern.

Figure 3:
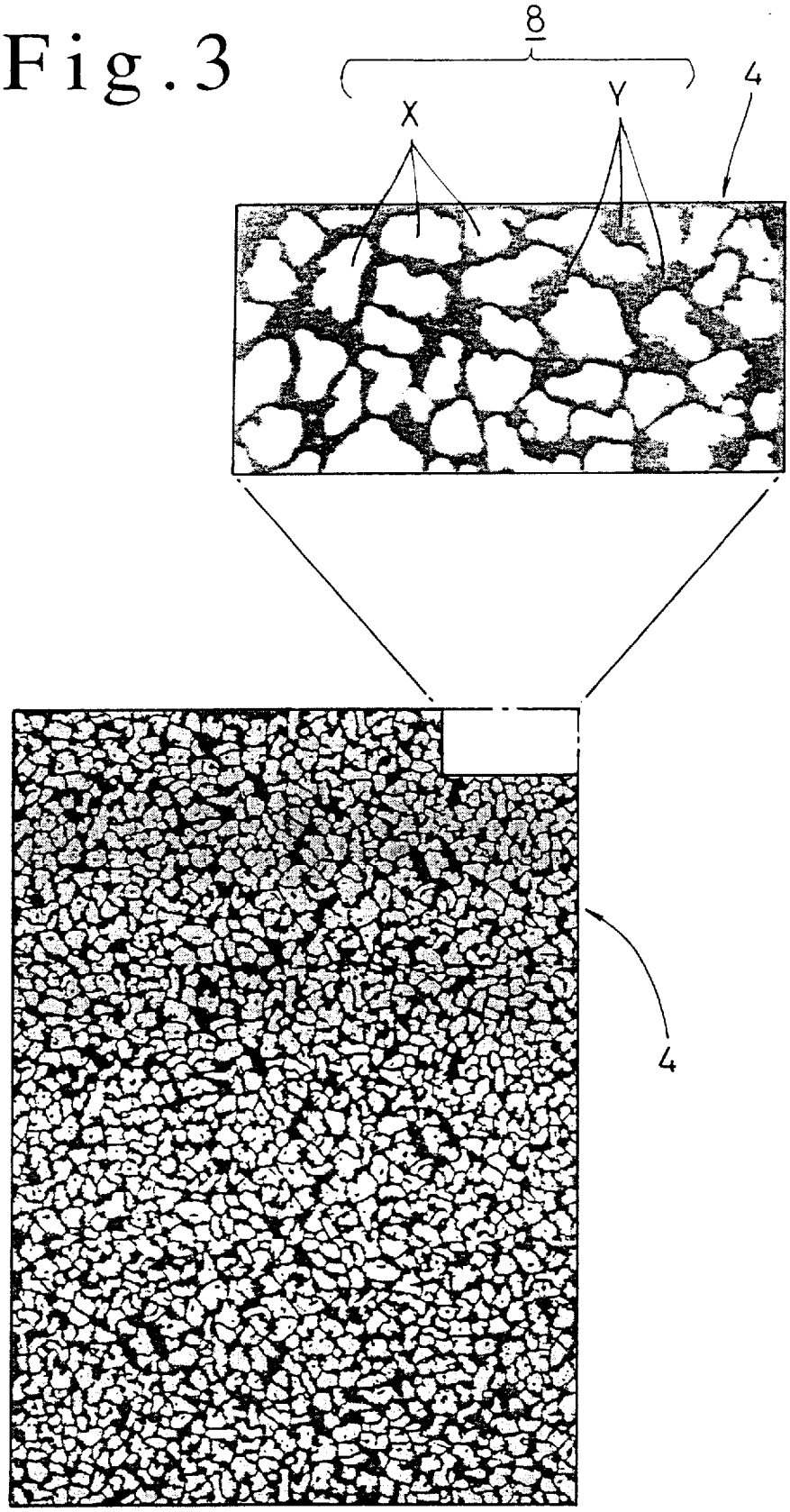
FIG. 3 is a plan view illustrating the appearance of a surface decorated article formed with a coating of a glitter paint.

Then, in the coating 4, the area in which the paint particles 6 at a low viscosity are dried to solidify forms a bright spot area X emitting brilliant gloss by reflection of light, while the area in which paint particles 7 at a high viscosity are dried to solidify forms a dark spot area Y releasing dark gloss, to develop a spot pattern 8 as shown in FIG. 3 in which a number of the bright spot areas X and the dark spot areas Y are present in admixture.

That is, since the paint particles 6 at a low viscosity with a relatively high solvent dilution ratio show large volume shrinkage upon evaporation of the solvent, the flaky glitter material 3 contained in the paint particles flows in the direction parallel with the surface of the substrate 1 as the coating surface by the effect of the volume shrinkage caused when the paint particles are painted on the surface of the substrate 1 and dried to solidify, into a state in which they are arranged horizontally as shown in FIG. 1, FIG. 4 and FIG. 7. Accordingly, they form a bright spot area X with a large hiding power and high reflectance of light on the coated surface.

On the other hand, since paint particles 7 at a high viscosity with a relatively low solvent dilution ratio show relatively small volume shrinkage upon evaporation of the solvent, the flaky glitter material 3 flows less by the effect of the volume shrinkage and not much flaky glitter material 3 is directed in parallel with the surface of the substrate 1 as the coated surface, so that they form a dark spot area Y with a small hiding power and low light reflectance on the coated surface.

Accordingly, the coating 4 of the glitter paint formed on the substrate 1 develops a unique spot pattern 8 is which a number of bright spot areas X and dark spot areas Y emitting different bright/dark glitter are in admixture with each other, as well as develops an apparent uneven feeling in the plane state being coupled with the dark and bright contrast created by the interlaced bright spot areas X and the dark spot areas Y, and a visual effect that the degree of glitter and the degree of light reflection in each of the bright spot areas X and the dark spot areas Y change subtly depending on the viewing angle, to provide the entire appearance with a deep and high quality feeling.

In order to clearly develop the spot pattern 8 of the coating 4, it is desirable to select the solvent dilution ratio for both of the paints such that the difference of content of a non-volatile component (ΔNV) between the glitter paint at a low viscosity coarsely particulated by the coating machine 5A and the glitter paint at a high viscosity coarsely particulated by the coating machine 5B is at least from 5 to 8% by weight upon coarse particulation and from 10 to 20% by weight upon coating to the surface of the substrate 1.

If the difference of the content of the non-volatile component (ΔNV) is less than the above-specified value, since the volume shrinkage of the paint particles 6 at a low viscosity and that of the paint particles 7 at a high viscosity coated on the surface of the substrate 1 are excessively similar with each other, the dark/bright contrast between the bright spot areas X and the dark spot areas Y is weakened to make the spot pattern 8 unclear, and even make it difficult to distinguish the bright spot area X and the dark spot area Y, so that the spot pattern 8 tends to disappear.

Further, it is preferred that the glitter paints are coarsely particulated by the coating machines 5A and 5B to such an extent that the average grain size of the paint particles 6 and 7 upon coarse particulation is from 50 to 500 $\mu$m. If the grain size is less than 50 $\mu$m, it is difficult to visually recognize the bright spot area X and the dark spot area Y as spots to lose the impression of the spot pattern. On the other hand, if the grain size is large than 500 $\mu$m, quality of the coating 4 is deteriorated.

Each of the content of the glitter material (PWC) in the glitter paint at a low viscosity and in the glitter paint at a high viscosity coarsely particulated by the coating machines 5A, 5B is adjusted and controlled widely within a range from 1 to 20% by weight based on the entire amount of each paint, by which tones for the spot pattern 8 developed by the coating 4 can be varied remarkably. That is, the content of the glitter material (PWC) of metallic paints used in usual metallic coating is about 10% by weight based on the entire amount of the paint and, if the content is at least 1% by weight or more, a metallic feeling of emitting gloss by the reflection of light can be obtained and, if it is less than 20% by weight, there is no worry of deteriorating the quality of the coating.

The glitter paint includes, for example, colorless silver, silver gray, gold, blue, red, yellow and violet colors, and paints with low and high solvent dilution ratios may be prepared from paints of identical color by using the paints of a single color or of a mixed color, or the paints with low and high solvent dilution ratios may be prepared from using paints of different colors.

The glitter material 3 to be blended with the glitter paint is not limited to metallic pigments such as an aluminum powder, aluminum flake formed by slitting aluminum foil, vapor deposited flake formed by slitting vapor deposited foil but it may be also pearlescent pigments such as mica titanium formed by coating titanium dioxide on mica flakes.

Further, means for coarsely particulating two or more glitter paints with different solvent dilution ratios simultaneously is not restricted to the use of two or more coating machines as shown in FIG. 2 but a coating machine having two or more paint spray nozzles or paint supply nozzles may also be used.

In the surface decorated article shown in FIG. 1, a coating 9 of a clear paint is formed as a surface protection layer on the coating of the glitter paint that develops the spot patterns.

Figure 5:
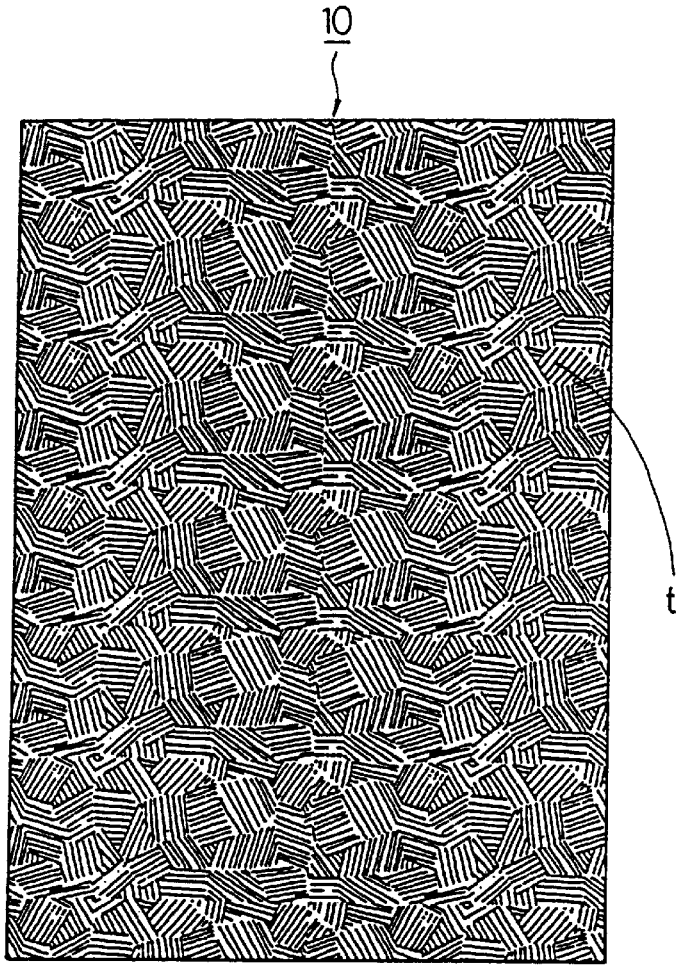
FIG. 5 is a view illustrating an example of an ink pattern printed on the coating of a glitter paint.
Figure 6:
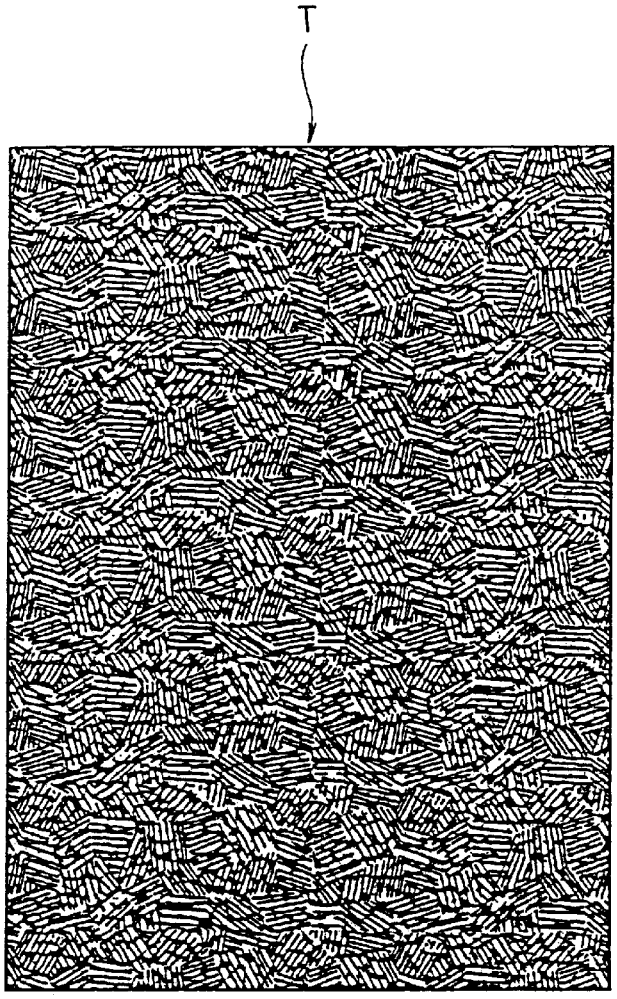
FIG. 6 is a plan view illustrating the appearance of the surface decorated article on which an ink pattern is printed.

Then, in the surface decorated article shown in FIG. 4, an ink pattern 10 showing a herringbone twill pattern t as shown in FIG. 5 is printed by a hydraulic pressure transfer on the surface of the coating 4 of the glitter paint that develops the spot pattern 8 and then a coating 9 of a clear paint is formed as surface protection layer on the coating 4 to develop a synthetic pattern T comprising the spot pattern 8 and the ink pattern 10.

If the synthetic pattern T comprises, for example, a glitter coating material of silver gray to constitute the coating 4 and a herringbone twill pattern t of black constituting the ink pattern 10, a black herringbone twill pattern t develops on the background color of the silver gray, which exhibits an elegant and calm appearance like that a tweed fabric as a traditional woven fabric in England, and this exhibits a graceful and high quality appearance with deep and spatial feeling, being coupled with a visual effect such as bright/dark contrast and change of gloss in the spot pattern 8 developed by the coating 4.

Figure 9:
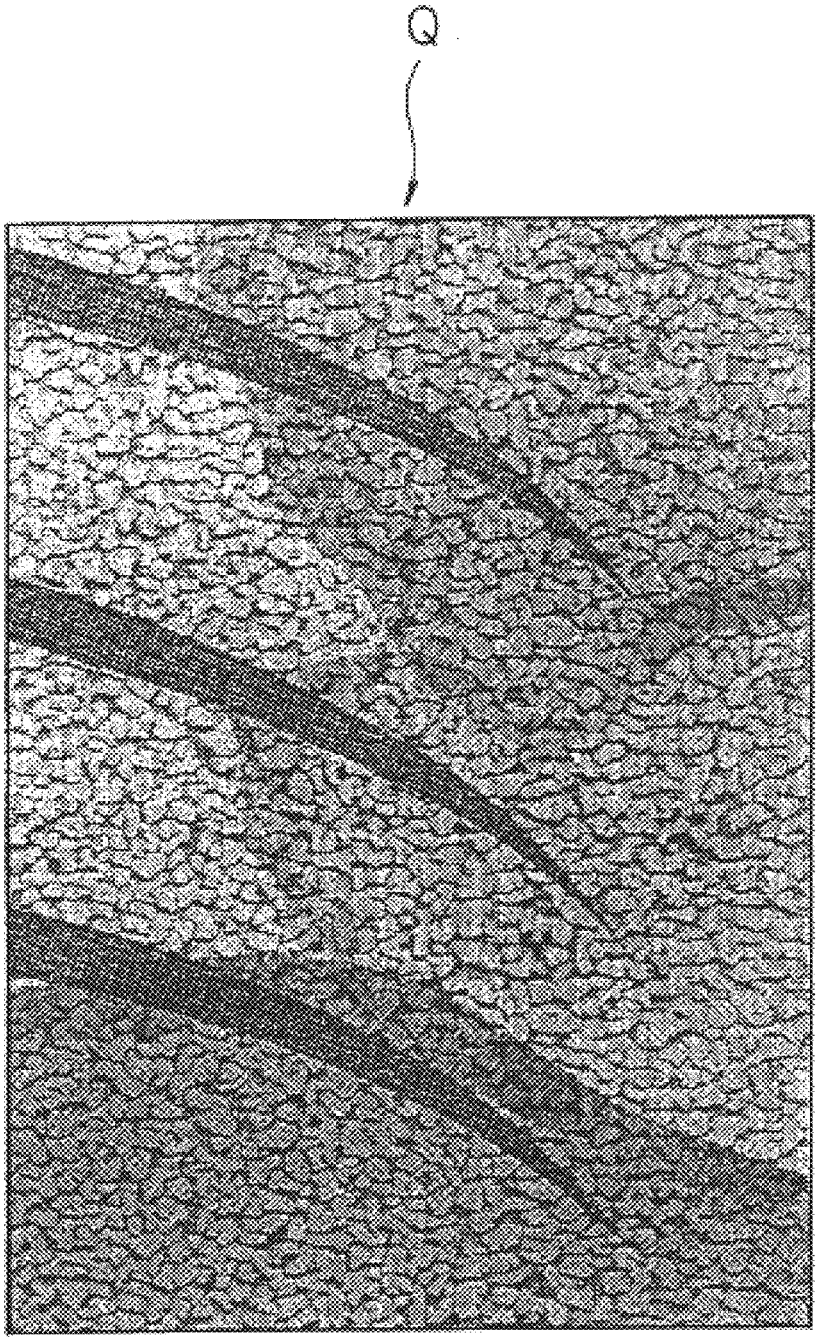
FIG. 9 is a plan view illustrating the appearance of a surface decorated article on which the ink pattern is printed.

Then, in the surface decorated article as shown in FIG. 7, a coating 11 of a clear paint is formed on the coating 4 of the glitter paint that develops the spot pattern 8. After printing an ink pattern 12 showing cloud-shaped patterns $q_1$, $q_2$, $q_3$ and a grass leave-shaped patter $q_4$ on the surface of the coating 11, a coating 13 of a clear paint is formed as the surface protection layer on the coating 11 to develop synthetic pattern Q with the spot pattern 8 and the ink pattern 12 as shown in FIG. 9.

If the coating 4 is formed with a glitter paint of silver gray or colorless silver, and the cloud-shaped patterns $q_1$, $q_2$ and $q_3$ and the grass leave-shaped pattern $q_4$ in the ink pattern 12 are of red, blue, yellow and green colors, the synthetic pattern Q exhibits a gorgeous appearance as if it were cloisonnè articles with multicolor relief of silver foils.

Namely, the surface decorated article of FIG. 7 showing the synthetic pattern Q comprising the spot pattern 8 developed by the coating 4 formed with the glitter paint of silver color and the ink pattern 12 showing cloud-shaped patterns $q_1$, $q_2$, $q_3$ and the grass leave-shaped pattern $q_4$, respectively colored as red, blue, yellow and green exhibits an appearance closely similar with cloisonnè of multicolor relief or silver foils formed by applying pigmenting glazes of several colors on a silver foil substrate formed by baking silver foils on the surface of the substrate. Therefore, according to the present invention, a high quality surface decorated article which may be a substitute for cloisonnè articles which are expensive and difficult to be mass produced can be produced at a reduced cost and in a mass production scale.

As shown in FIG. 7, when a coating 11 of a clear paint is formed on the coating 4 of the glitter paint developing the spot pattern 8, and the ink pattern 12 is printed on the surface of the coating 11, a transparent layer comprising the coating 11 of the clear paint is present between the spot pattern 8 and the ink pattern 12, to further emphasize the deep and spatial feeling of the synthetic pattern Q constituted with both of the patterns 8 and 12 overlapped with each other.

The present invention can provide an excellent effect capable of providing the surface of various kinds of articles with unique and high quality feeling of colors or textures, by using a glitter paint containing a flaky glitter material as a pigment, and forming a coating developing a spot pattern comprising bright areas of the glitter material of bright and dark areas of the glitter material of dark gloss being present in admixture.

What is claimed is:

1. A method of decorating a surface decorated article by using glitter paints each containing a flaky glitter material as a pigment, wherein the method comprises:

particulating a first glitter paint at a first viscosity with a first solvent dilution ratio to form first paint particles and a second glitter paint at a second viscosity with a second solvent dilution ration to form second paint particles, respectively, and, at the same time, coating the first and second paint particles in a state being mixed with each other on the surface decorated article, thereby forming a coating of the mixed glitter paints on the surface, wherein the first viscosity is lower than the second viscosity and the first solvent dilution ratio is higher than the second solvent dilution ration.

2. A decoration method as defined in claim 1, wherein the average grain size of the first and second paint particles upon particulation is from 50 to 500 $\mu$m.

3. A decoration method as defined in claim 1, wherein the content of flaky glitter material in the first glitter paint and in the second glitter paint is from 1 to 20% by weight based on the entire amount of the paint.

4. A decoration method as defined in claim 1, wherein the solvent dilution ratio for each of the first and second paints is selected such that the difference of content of non-volatile components (ΔNV) between the first glitter paint and the second glitter paint is at least 5 to 8% by weight upon coarse granulation and from 10 to 20% by weight upon coating.

5. A decoration method as defined in claim 1, wherein the coating includes areas of dried, solidified first paint particles and areas of dried, solidified second paint particles mixed together in a spot pattern.

6. A decoration method as defined in claim 1, further comprising forming a coating of clear paint on the coating of the mixed glitter paints.

7. A decoration method as defined in claim 1, further comprising printing an ink pattern on the coating of the mixed glitter paints.

8. A decoration method as defined in claim 7, wherein the printing is performed by a hydraulic pressure transfer.

9. A decoration method as defined in claim 7, further comprising forming a coating of clear paint on the coating of the mixed glitter paints and the ink pattern.

10. A decoration method as defined in claim 6, further comprising printing an ink pattern on the coating of clear paint.

11. A decoration method as defined in claim 10, further comprising forming a second coating of clear paint on the coating of clear paint with the ink pattern printed thereon.

* * * * *